428-408 SR
10/11/83 XR 4,409,288

United States Patent [19]
Spain

[11] 4,409,288
[45] Oct. 11, 1983

[54] EPOXY RESIN EMULSION FINISHES FOR CARBON FIBERS

[75] Inventor: Raymond G. Spain, Huntington Beach, Calif.

[73] Assignee: Hitco, Irving, Calif.

[21] Appl. No.: 372,673

[22] Filed: Apr. 28, 1982

[51] Int. Cl.[3] ..... B32B 9/00; D02G 3/00
[52] U.S. Cl. ..... 428/367; 428/375; 428/408; 427/386; 523/402
[58] Field of Search ..... 428/367, 375, 408, 413, 428/372; 427/386, 389; 523/402

[56] References Cited

U.S. PATENT DOCUMENTS

| | | | |
|---|---|---|---|
| 3,837,904 | 9/1974 | Hill | 427/386 |
| 3,839,252 | 10/1974 | Bosso et al. | 523/402 |
| 4,069,210 | 1/1978 | Schimmel | 523/402 |
| 4,096,104 | 6/1978 | Spain et al. | 428/367 |
| 4,167,538 | 9/1979 | Taniguchi et al. | 428/375 |

*Primary Examiner*—Marion McCamish
*Assistant Examiner*—Beverly K. Johnson
*Attorney, Agent, or Firm*—Roylance, Abrams, Berdo & Farley

[57] ABSTRACT

There is disclosed a method of treating carbon fibers to provide an epoxy resin finish thereon. An aqueous emulsion of an epoxy resin is applied to the fibers and the fibers are thereafter dried. An effective amount of two different emulsifying components are used in the epoxy resin emulsion. One of the emulsifying components is a long chain aliphatic alcohol containing from eight to 18 carbon atoms. The other emulsifying component is a quaternary ammonium salt having the formula:

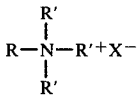

wherein R is an aliphatic radical containing from 12 to 18 carbon atoms, or a mixture of such radicals, each R′ may be the same or different radicals selected from methyl and ethyl, and x is bromine or chlorine.

16 Claims, No Drawings

EPOXY RESIN EMULSION FINISHES FOR CARBON FIBERS

BACKGROUND OF THE INVENTION

This invention relates to a finish composition for carbon fibers, and in particular to a method of treating the surface of carbon fibers with an aqueous emulsion of an epoxy resin.

Carbon fiber is conventionally produced by subjecting an organic polymer fiber to various conditions of temperature and atmosphere. Thus, for example, polyacrylonitrile fiber may be heated at a temperature in the range of 200° to 300° C. in an oxidizing atmosphere and subsequently heated at a temperature of at least 1000° C. in an inert atmosphere to give carbon fiber.

It is known to provide carbon fibers with a sizing to facilitate handling and processing. When such fibers are processed without application of a sizing, they tend to fuzz and may actually separate or break as they are pulled over pulleys, rollers, etc.

In many applications, carbon fibers, filaments, yarns to tows are woven into a fabric or tape or otherwise interlaced or overlapped such that the strands are in contact with other similar strands. Because of the high moduli, brittleness and relatively poor abrasion resistance of the strands or the fibers which comprise them, they are difficult to handle during their processing and weaving into fabrics and tapes. These problems have been overcome in the past by the application to the fibers of a size.

U.S. Pat. No. 4,145,472 to R. G. Spain and A. L. Miller describes problems encountered using solutions of sizing materials which contain organic solvents and states that in order to avoid the problems encountered with such solutions, aqueous emulsions have been used as sizings such as aqueous emulsions of epoxy resins. However, problems have been encountered using aqueous emulsions, e.g., the emulsifying agents which are present on the coated fibers after they are dried may seriously degrade the properties of composites ultimately made from the carbon fibers so sized.

SUMMARY OF THE INVENTION

It has now been discovered that the heretofore discussed disadvantages encountered with aqueous emulsions as sizes for carbon fibers may be overcome by applying a finish to carbon fibers, said finish comprising an aqueous epoxy emulsion which includes an effective amount of a two component emulsifying system. One of the emulsifying components is a long chain aliphatic alcohol, i.e., one containing from eight to 18 carbon atoms. The other emulsifying component is a quaternary ammonium salt having the formula:

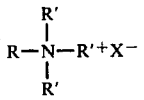

wherein R is an aliphatic radical containing from 12 to 18 carbon atoms, or a mixture of such radicals, e.g., cetyl or a mixture of cetyl and octyl, each R′ may be the same or different radicals selected from methyl and ethyl, and X is bromine or chlorine. From about 2 to 4% by weight of each emulsifying component, based on the combined weight of epoxy resin and emulsifying components, is preferably used in the emulsion. The maximum particle size of the solids in said emulsion is preferably 2.5 microns in diameter. The aqueous emulsion preferably has a solids content of about 0.3 to 2.5% by weight. The emulsion is coated on the carbon fiber and dried.

The finish emulsion used in the practice of this invention is stable in that it does not irreversibly coagulate even at concentrations as low as 0.3% by weight of solids. When applied to carbon tows, it greatly improves the handling characteristics of the fiber bundles. The finish allows the weaving of tows to fabrics at practical conditions. A tow coated with the finish does not "block" or self-adhere on long term storage on tightly wound bobbins. Further, the finish is compatible with epoxy resin matrices, i.e., it does not significantly reduce composite fiber-epoxy resin matrix bonding over a wide temperature range in comparison to a non-finish coated fiber-epoxy resin matrix.

DETAILED DESCRIPTION OF THE INVENTION

The epoxy resins which are suitable for use in this invention are well known in the art. An example is the diglycidyl ether of Bisphenol A, normally formed as a condensation product of epichlorohydrin and Bisphenol A (i.e., bis(4-hydroxyphenyl)dimethylmethane). Condensation products of epichlorohydrin with other polyhydric alcohols may also be used such as the diglycidyl ether of Bisphenol F (i.e., 4,4′-dihydroxybiphenyl). Other suitable epoxy resins include those derived from epoxidized glycerin dialiphatic esters, 1,4′-bis(2,3-epoxy-propoxy)benzene; 1,3-bis(2,3-epoxy-propoxy)-benzene; 4,4′-bis(2,3-epoxy-propoxy)diphenyl ether; 1,8-bis(2,3-epoxy-propoxy)octane; 1,4′-bis(2,3-epoxy-propoxy)cyclohexane; 4,4-bis(2-hydroxy-3,4′-epoxy-butoxy)-2-chlorocyclohexane; 1,3-bis(2-hydroxy-3,4-epoxy-butoxybenzene) and 1,4-bis(2-hydroxy-4,5-epoxy-pentoxy)benzene.

A commercially available epoxy resin which has been successfully used in the practice of this invention is Epon 834, a viscous diglycidyl ether of bisphenol A having an epoxy equivalent weight in the range of 230–280 and a viscosity in the range of 15,000–22,500 centipoises at 25° C.

If the epoxy resin is highly viscous as supplied, it is preferable to dilute it with a compatible organic solvent, e.g., xylene, to reduce the resin viscosity and facilitate subsequent high shear mixing of the emulsion. The diluent can be eliminated if the epoxy resin is mixed with water at an elevated temperature to reduce resin viscosity.

It is preferred to prepare an initial emulsion concentrate of from about 40 to 60% by weight of solids. To prepare this concentrate, the epoxy resin, the organic diluent if required, the emulsifying components, e.g., cetyl trimethylammonium bromide and cetyl alcohol, the remainder being water, preferably deionized water, are subjected to high shear mixing. Other alcohols may be used instead of cetyl alcohol such as 1-octanol or 1-decanol or a mixture of 1-octanol and cetyl alcohol. After the emulsion concentrate has been prepared, it is diluted to about 0.3 to 2.5% by weight of solids with deionized water. The resultant emulsion is highly stable to coagulation.

The method of applying the finish to the carbon fiber consists of pulling the material under a roll which is partially immersed in the epoxy emulsion, as by use of a dip tank in conjunction with automatic processing equipment for continuously running the carbon fibers through the dip tank. The fibers are immersed in the aqueous emulsion long enough to provide thorough wetting of the fibers.

Upon removal of the carbon fibers from the dip tank, the fibers are dried so as to remove the water, e.g., by passing through a bank of quartz lamps which heats the material to a specified temperature, typically in excess of the boiling temperature of water. The epoxy resin is present on the carbon fibers as a uniform coating. The finish lubricates the carbon fibers so as to prevent damage during subsequent handling and, at the same time, acts as a barrier between the fibers and the surface contacts. As is well known in the art, composites are prepared by impregnating carbon fibers with a thermosetting resin, e.g., epoxy resin.

In a typical process for making a composite from sized carbon fibers, the sized fibers which appear in tow, cloth or other appropriate form are impregnated with an epoxy resin and placed in a mold or otherwise in an appropriate configuration prior to curing the resin. The curing process may vary, but typically involves heating the impregnated fibers from room temperature to about 275° F. at a rate of about 5° F. per minute in an autoclave. Thereafter the composite is maintained at 275° F. for about 30 minutes, following which elevated pressure on the order of 100 psi may be applied, as desired. The composite is then heated to about 300° F. for about 15 minutes, following which an elevated pressure of about 100 psi is applied if it was not applied previously. The composite is then heated to about 350° F. and is maintained at that temperature for about two hours. Thereafter, the composite is cooled under pressure to about 200° F. and is removed from the autoclave. Depending upon the resin an optional post cure step of heating to about 400° F. for about two hours may be employed.

The following example illustrates the best mode contemplated for carrying out this invention. In this example, all parts are by weight.

EXAMPLE

Epon 834 epoxy resin (93.10 parts) and xylene (16.43 parts) are added to a mechanical mixer and mixed at 1400 rpm for 10 minutes using a high shear mixing blade. Cetyl trimethylammonium bromide (3.45 parts) and cetyl alcohol (3.45 parts) are added and mixing is continued at 1400 rpm for 20 minutes. The speed of mixing is slowly increased to 4900 rpm and deionized water (about one quarter of 133.57 total parts) is added over a period of about five minutes. Mixing at 4900 rpm is continued for 20 minutes. The particle size of the solids in the resultant emulsion are all under 2.5 microns in diameter. The remainder of the water is added with mixing at 1400 RPM for about 15 minutes. This emulsion is diluted to about 0.3 to 2.5% solids with deionized water and coated on carbon fiber as follows:

The finish is applied to carbon fibers by immersing the tows under a roller in a dip bath so that the tows are under the level of the coating emulsion for a period of five seconds or longer followed by heating to dry the finish on the carbon fiber. For a tow of 3000 filaments, a tensioning force of 0.3 pounds or more is utilized to maintain alignment of the tows during the coating process.

The weight percent finish in dry form applied to the carbon fibers is approximately that of the percent solids of the emulsion coating bath. Hence, the amount of finish applied to the carbon fiber can be controlled by maintenance of the percent solids of the coating emulsion. Over the finish range of 0.3 to 2.5% by weight the degree of protection from mechanical damage increases, so that for the rigorous mechanical handling encountered in weaving the tows to fabrics finish levels of 0.8% by weight or more are preferred. Without the protective finish, weaving of a practical nature cannot be accomplished due to the massive mechanical damage to the tows.

Carbon tows of 3000 filaments with a finish level of 1.27% by weight, the finish having been prepared as described in the foregoing example, were impregnated with U.S. Polymeric E707 epoxy resin, formed into a unidirectional laminate, and cured as previously described. Composite properties at room temperature and at 350° F. were determined to be:

| | Room Temperature | 350° F. |
|---|---|---|
| Flexural Strength, ksi | 284.6 | 193.4 |
| Flexural Modulus, msi | 20.6 | 17.0 |
| Shear Strength, ksi | 18.1 | 9.5 |

1 ksi = $1 \times 10^3$ lb/in.$^2$
1 msi = $^1 \times {}^{106}$ lb/in.$^2$

What is claimed is:

1. In a method of treating carbon fibers to provide an epoxy resin finish thereon in which an aqueous emulsion of an epoxy resin is applied to said fibers and said fibers are thereafter dried, the improvement which comprises using an effective amount of a two component emulsifying system in said epoxy resin emulsion, one of said emulsifying components being a long chain aliphatic alcohol containing from eight to 18 carbon atoms, the other emulsifying component being a quaternary ammonium salt having the formula:

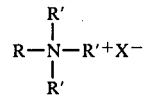

wherein R is an aliphatic radical containing from 12 to 18 carbon atoms, or a mixture of such radicals, each R′ may be the same or different radicals selected from methyl and ethyl, and X is bromine or chlorine.

2. A method as defined in claim 1 wherein said emulsion contains from about 2 to 4% by weight of each emulsifying component, based on the combined weight of epoxy resin and emulsifying components.

3. A method as defined in claim 1 wherein said emulsifying components are cetyl alcohol and cetyl trimethylammonium bromide.

4. A method as defined in claim 2 wherein said emulsifying components are cetyl alcohol and cetyl trimethylammonium bromide.

5. A method as defined in claim 3 wherein the maximum particle size of the solids in said emulsion is 2.5 microns in diameter.

6. A method as defined in claim 4 wherein the maximum particle size of the solids in said emulsion is 2.5 microns in diameter.

7. A method as defined in claim 5 wherein said aqueous emulsion has a solids content of from about 0.3 to 2.5% by weight.

8. A method as defined in claim 6 wherein sid aqueous emulsion has a solids content of from about 0.3 to 2.5% by weight.

9. Carbon fibers having a uniform coating of epoxy resin thereon obtained by the process of claim 1.

10. Carbon fibers having a uniform coating of epoxy resin thereon obtained by the process of claim 2.

11. Carbon fibers having a uniform coating of epoxy resin thereon obtained by the process of claim 3.

12. Carbon fibers having a uniform coating of epoxy resin thereon obtained by the process of claim 4.

13. Carbon fibers having a uniform coating of epoxy resin thereon obtained by the process of claim 5.

14. Carbon fibers having a uniform coating of epoxy resin thereon obtained by the process of claim 6.

15. Carbon fibers having a uniform coating of epoxy resin thereon obtained by the process of claim 7.

16. Carbon fibers having a uniform coating of epoxy resin thereon obtained by the process of claim 8.

* * * * *